US006161252A

United States Patent [19]

Rodriguez

[11] Patent Number: 6,161,252

[45] Date of Patent: Dec. 19, 2000

[54] FOOT RELEASED OPEN DOOR HOLDER

[76] Inventor: Miguel Angel Loera Rodriguez, 513 W. San Antonio #12, El Paso, Tex. 79901

[21] Appl. No.: 09/336,991

[22] Filed: Jun. 21, 1999

[51] Int. Cl.[7] ..... E05F 5/02

[52] U.S. Cl. ..... 16/82; 16/85; 16/86 R; 292/342; 292/338; 292/255; 292/DIG. 15

[58] Field of Search ..... 16/85, 82, 86 R; 292/342, 343, 338, 339, 255, 390, DIG. 15

[56] References Cited

U.S. PATENT DOCUMENTS

| | | | |
|---|---|---|---|
| 108,534 | 10/1870 | Sweetland | 292/339 |
| 3,805,322 | 4/1974 | Serrano | 16/82 |
| 5,056,836 | 10/1991 | Wells | 292/288 |
| 5,447,347 | 9/1995 | Siddons | 292/342 |
| 5,465,460 | 11/1995 | Cantone | 16/82 |
| 5,809,613 | 9/1998 | Baines | 16/82 |

*Primary Examiner*—Anthony Knight
*Assistant Examiner*—E Peavey
*Attorney, Agent, or Firm*—Patent & Trademark Services; Thomas Zack; Joseph H. McGlynn

[57] ABSTRACT

A door holder assembly used to maintain a door in an opened position. The assembly is made up of a door stop, a locking plate mounted on the door and a floor mounted door holder. The door stop and the door holder are fixed to the floor while the locking plate is fixed to the lower portion of the door and is positioned to engage the door holder when the door is opened. The locking plate has two joined segments one of which is planar and flat while the other of which has a right angled groove. Depending on the vertical elevation of the door's bottom above the floor, the same locking plate can be mounted to the door in one of two different positions. If the elevation is slight then the right angled groove portion is mounted on the vertical front door surface. If the elevation is larger and sufficient space exists, the locking plate may have the right angled groove portion mounted to the lower edge of the door between the door and the floor. In either plate mounting, a free end of the door holder engages the locking plate's groove portion and may be released from this engagement by stepping down on an upper segment of the door holder.

6 Claims, 3 Drawing Sheets

FOOT RELEASED OPEN DOOR HOLDER

BACKGROUND OF THE INVENTION

This invention relates to door holder assembly used to keep a door in an opened position that has a foot release when it is desired to shut the door. Supplemental devices that relate to the operation of a conventional door are known. In some situations these devices are used to provide additional security to a shut door to prevent its opening.

In the prior art a foldable door security device has two members one of which engages the bottom of the door while the other member with its prongs engages a penetrable floor covering. Another security device set up, uses a door stop that, when actuated by a user's foot, raises from a seated position and in that raised position resembles the shape of a wedge whose base bears against the bottom of the door to keep it shut. Still another door stop configuration resembles blocks which engage the bottom of the door with one of the block members being spring loaded and operated by foot pressure to permit the door to be opened. In another security foot operated door stop device one element is secured to the floor and is normally parallel to the floor but can be elevated by foot pressure to prevent a door from being completely opened.

The present invention differs from these security and door stop devices by providing for two unique interrelated members one of which is fixed to the door's bottom and the other of which is fixed to the floor to keep the door opened all as will be described in detail hereafter.

DESCRIPTION OF THE PRIOR ART

Supplemental add-on devices that are used with a conventional door to maintain the door either in an opened or a closed position are known. For example, in the Wells invention, U.S. Pat. No. 5,056,836 a door security device is disclosed having two pivotally connected members one of which engages the door's lower side and the other with its tapered prongs engaging a carpet or other penetratable floor covering.

U.S. Pat. No. 5,447,347 to Siddons discloses an auxiliary door stop which, when raised by foot pressure from a receptacle in the floor, resembles the shape of a wedge.

U.S. Pat. No. 5,465,460 to Cantone discloses a doorstop having two block members one of which is a striker block and the other of which is a pivotally mounted block that is spring biased and foot operated to hold the door in a closed position.

U.S. Pat. No. 5,809,613 to Baines discloses a foot-operated door stop assembly having one member secured to the floor and other another member which can be either parallel to the floor or raised by foot pressure to prevent the door from being completely opened.

SUMMARY OF THE INVENTION

This invention relates to floor mounted door stop assembly having a locking plate fixed to the door and an engaging floor mounted door holder and door stop member. The locking plate is reversible in position on the door to accommodate door bottom's having different elevations from the underlying floor.

It is the primary object of the present invention to provide for an improved foot operated door stop assembly that will maintain a door in an opened position.

Another object is to provide for such an assembly that has one door fixed locking plate that can be used to postioned on the door to take into consideration different vertical elevations between the door and the underlying floor.

These and other objects and advantages of the present invention will become apparent to readers from a consideration of the ensuing description and the accompanying drawings.

DESCRIPTION OF THE PREFERRED EMBODIMENT

Figure 1:
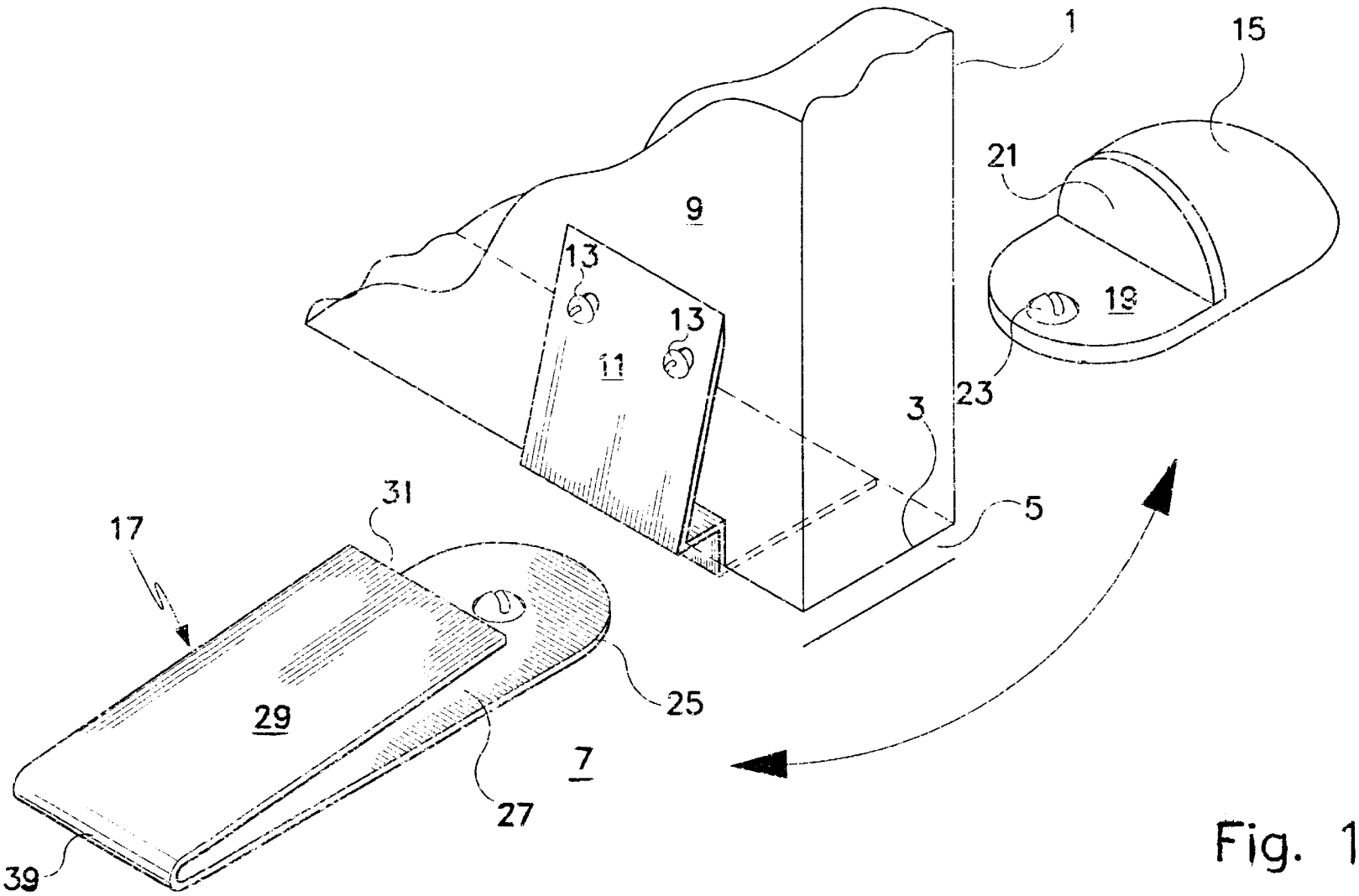
FIG. 1 is a perspective view of the present invention when used with a conventional door.

FIG. 1 is a perspective view of the present invention when used with a conventional mounted door 1 that can swing on hinges to a door frame in the direction of the arrows. Below the bottom edge of the door 3, separated by the vertical spacing 5, is the underlying horizontally disposed floor 7. Fixed to the door's bottom edge 3 and the door's front planar surface member 9 is the locking plate 11. Plate 11 may be held to the door by screws 13 two of which are shown.

Aligned in a straight line with the center of plate 11 are the centers of the rear door stop 15 and the front door holder 17. The stop 15 is conventional in design and has a floor engaging horizontal base segment 19 that fits under the door's edge 3 and a vertical door bearing surface segment 21. A screw hole in segment 19 receives a screw 23 which fixes the stop to the lower floor 7. Similarly, screws 25 (one shown) fit through two spaced holes in the horizontally disposed base 27 of the holder 17. The screws 25 are used to engage the floor 7 and hold the holder 17 is a fixed position relative to the aligned door stop 15. Joined to the holder's lower base 27 is the upper holder segment 29 whose terminal free end portion 31 is normally higher than the door's edge 3. This end portion 31 is what actually engages the door's locking plate 11. As will be described in greater detail with respect to FIGS. 2,3 and 5 (*a*) and 5(*b*), the locking plate 11 can be inverted in its position on the door surfaces 3 and 9 to take into consideration different spacing vertical elevations 5 between the door's edge 3 and the floor 7.

Figure 2:
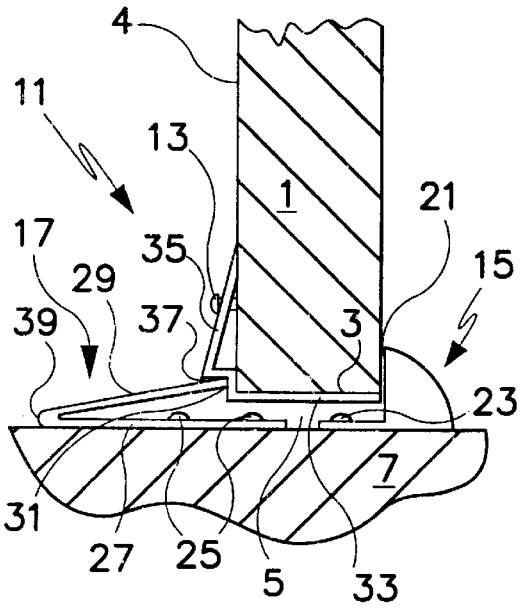
FIG. 2 is a cross sectional side view of the locking plate of FIG.1 being engaged by the door holder.

FIG. 2 is a cross sectional side view of the locking plate 11 of FIG.1 being engaged by the door holder. The plate is formed with two joined segments 33 and 35. The lower planar segment 33 is generally flat and, in this figure, fits flush against the flat lower door edge 3. The upper segment 35 has a lower right angle portion 37 which receives the free end 31 of the door holder 17. Directly above the upper part of portion 37, segment 35 is bent inwardly towards the surface 9 and then straightens vertical to end in a flat upper surface having spaced holes for receiving the two screws 13.

Also shown in FIG. 2 is the door holder's bent joining portion 39. Holder portion 39 is further away from the opened door 1 when held in the opened position shown and is considerably lower than the edge 3. By stepping downwardly on the upper holder surface 29, its engaged free end 31 drops from its normal engagement position with the locking plate (37) to be lower than the edge 3 thus permitting the door 1 to be moved to the left over the holder 17. Screws are used to fixedly mount the stop 15 and holder 17 to the floor 7. Two additional screws 13 mount and fix the locking plate 11 to the area where the lower part of surface 9 joins perpendicularly with the lower flat door edge 3. Door engaged vertical stop surface 21 prevents the door 1 from moving to the right in this second figure.

Figure 3:
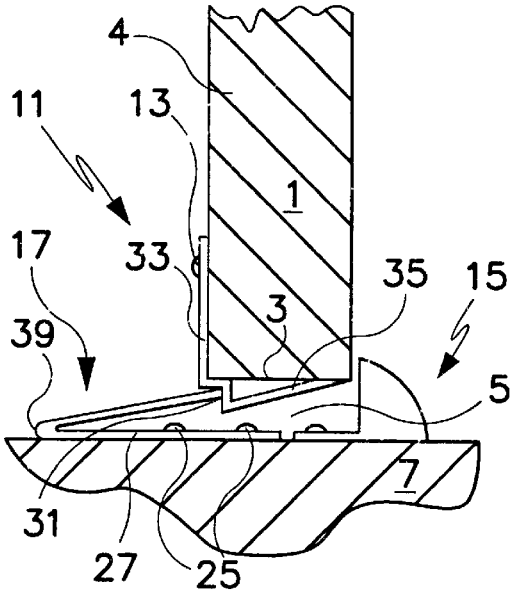
FIG. 3 is a cross sectional side view like FIG. 2 with the locking plate inverted to accommodate a door more elevated from the floor.

FIG. 3 is a cross sectional side view like FIG. 2 with the same locking plate 11 reversed in positon on the door to accommodate a door more elevated from the floor. The vertical spacing 5 in this figure between the floor 7 and the door edge 3 is greater in FIG. 3 than in FIG. 2. To take into consideration this added spacing the locking plate 11 has its two segments reversed from what is shown in FIG.2. Thus, the flat planar surface 33 in FIG. 3 lies flush against the upright door surface 9 while the locking plate segment 35 is below the door's edge 3. In this position the holder's free end 31 still engages the locking plate portion 37, however, the engagement occurs under the edge 3 not in the front of the door adjacent the surface 9. This engagement under the edge 3 is only possible if there is more than sufficient space 5 under the door to receive the segment 35 and additional space for the holder's base 27 and the stop's member 19 plus some free space to permit movement of the door.

Figure 4A:
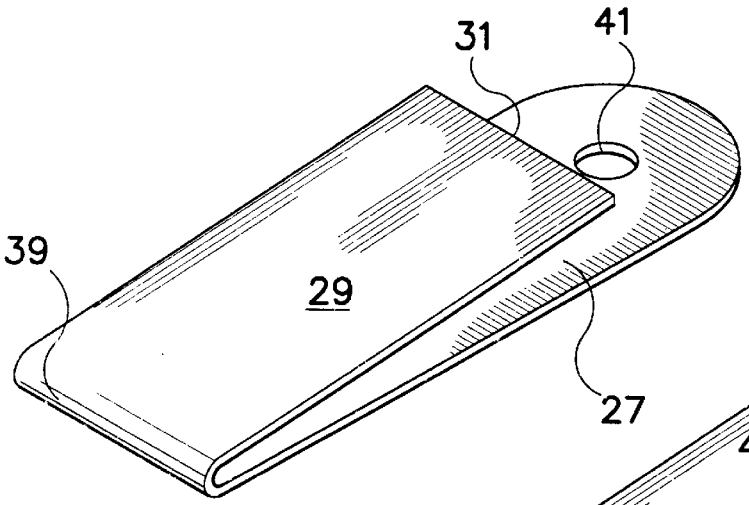
FIGS. 4(*a*) and 4(*b*) show top and bottom perspective views of the door holder.
Figure 4B:
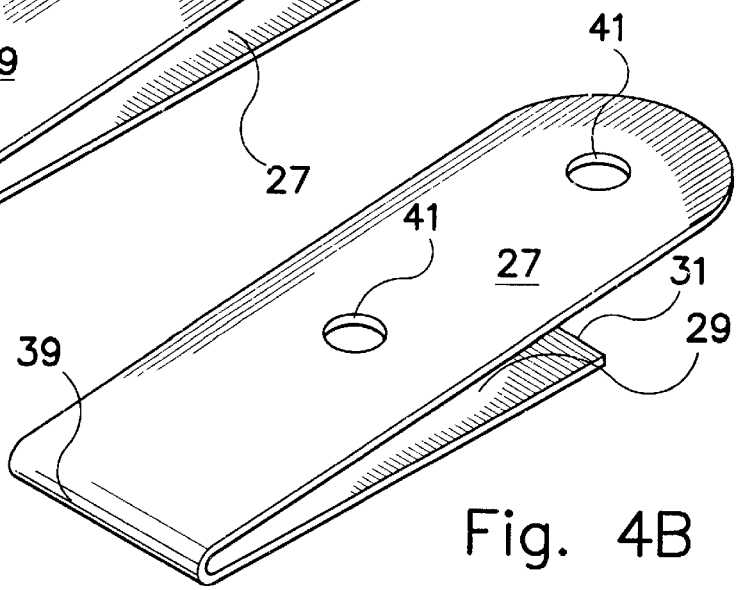

FIGS. 4(*a*) and 4(*b*) show top and bottom perspective views, respectively, of the door holder 17. The holder is a single unitary structure formed by the two segments 27 and 29 which are bent where joined (39) to overlap and face each other. In the top view, FIG. 4(*a*), the holder appears as in FIG. 1, except that the countersinked hole 41 used to receive the screw 25 is visible. The material making up the holder must have sufficient resiliency to be able to be compressed downwardly as the door edge 3 rides over it and the two facing holder surfaces 27 and 29 come together at the free end 31 is depressed. This same inherent resiliency of the material for the bent holder permits the free end 31 of upper segment 29 to engage the locking plate once the door edge 3 or the lower locking plate segment 35 (see FIG.3) is no longer bearing against this segment.

In the holder's bottom view, FIG. 4(*b*), the two spaced holes 41 in the base 27 are more clearly shown. Each hole has a top portion that is countersinked to receive screws whose fully inserted heads would lie flat with the base's upper surface when screwed into the floor 7.

Figure 5B:
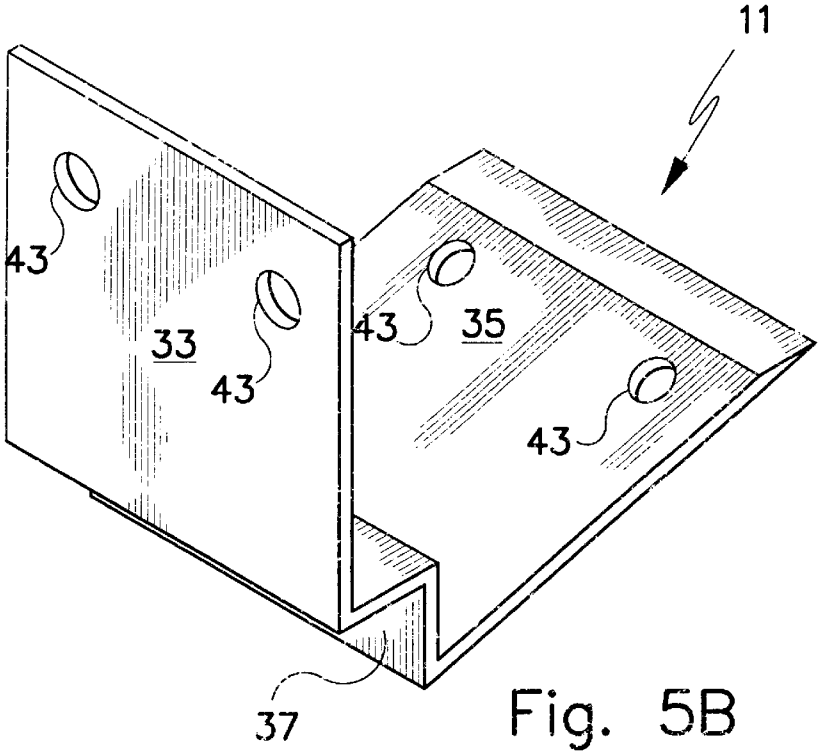
FIGS. 5(*a*) and 5(*b*) show perspective views of the same locking plate in two different positions.
Figure 5A:
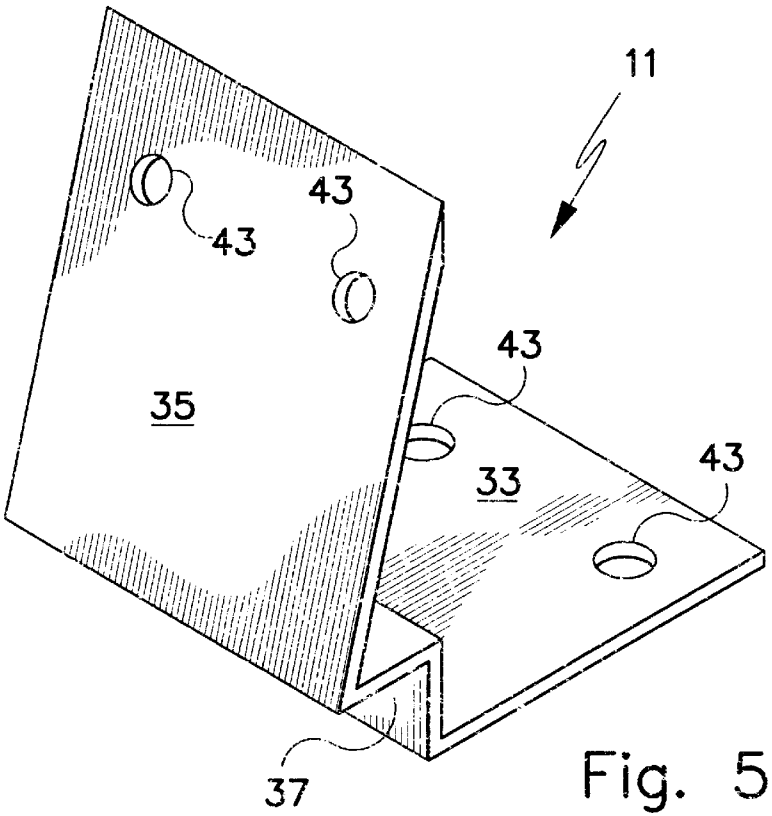

FIGS. 5(*a*) and 5(*b*) show perspective views of the same locking plate 11 in two different positions on the door. In the FIG. 5(*a*) position, like the plate's disposition in FIG. 2, the flat planar segment 33 is lower than the bent segment 35. The lower bent receiving segment 37 extends across the width of the locking plate and is sized and configured to receive the flat holder end 31 along its width. Four separate spaced through holes 43 extend through the plate 11. Two holes are in the segment 35 and two in the segment 33.

The illustrated FIG. 5(*b*) plate position is like the disposition in FIG. 3. The flat planar segment 33 is now in the upper position while the bent segment 35 is lower down. The end holding right angled edge 37 is attached at the lower part of segment 33 and extends to where it joins with the remainder of segment 35.

In one embodiment of the invention the locking plate segment 35 had an overall length of 1 ⅜ inches, a width of 1 ¼ inches while the right angled portion 37 was ⅜ inches on each of its two sides. The other locking plate segment 33 was the same width with a total length of 1 ⅜ inches. Both plate segments could be increased in total length to 1 ¾ in a larger locking plate version.

This invention is particularly useful for doors with hydraulic door closers when one desires to keep the door opened. However, it is not limited to such door and may be installed on wooden as well as metal doors. Once installed, the opened door is held in that position by the engagement of the locking plate with the door holder fixed to the floor. The rear door stop is positioned to sandwich the opened door between the holder and the stop. When it is desired to release the opened door, a user presses their foot slightly down on the upper holder segment 29 which disengages its free end 31 from the locking plate and allows the door to swing over the holder to a closed position.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A floor mounted door stop assembly comprising:

a locking plate fixedly mounted on the lower portion of a door, a stop positioned to stop the movement of a door past a predetermined position, a floor mounted door holder engageable with said locking plate to lock the door in an opened position, said door holder having a foot engaging upper segment joined to a lower floor engaging base whereby the depression of said upper segment will release the door holder from engagement with the locking plate to permit the moving of the door from the opened position, wherein said locking plate has a first segment joined to a second segment, said first segment including a bent portion and a grooved portion for receiving part of the door holder.

2. The door stop assembly as claimed in claim 1, wherein said second locking plate segment is a generally flat planar surface that can fit flush against a lower portion of the door.

3. The door stop assembly as claimed in claim 2, wherein said first locking plate segment is mountable on the lower edge of the door.

4. The door stop assembly as claimed in claim 2, wherein said first locking plate segment is mountable on the front vertical planar surface of a door.

5. The as claimed in claim 2, wherein said foot engaging upper segment of said door holder overlaps and is joined to said lower floor engaging base by a bend portion and is formed as a single unitary structure.

6. The as claimed in claim 5, wherein holder upper segment has free end portion which engages said locking plate's grooved portion to hold an opened door in position.

* * * * *